US006339977B1

(12) United States Patent
Lee et al.

(10) Patent No.: US 6,339,977 B1
(45) Date of Patent: Jan. 22, 2002

(54) REVERSIBLE RATCHET WRENCH

(76) Inventors: Song-Ming Lee; Yu-Chun Lee, both of PO Box 82-144, Taipei (TW)

( * ) Notice: Subject to any disclaimer, the term of this patent is extended or adjusted under 35 U.S.C. 154(b) by 0 days.

(21) Appl. No.: 09/717,259

(22) Filed: Nov. 22, 2000

(51) Int. Cl.[7] ..... B25B 13/46
(52) U.S. Cl. ..... 81/58.3; 192/43; 192/48.92
(58) Field of Search ..... 81/58, 58.3, 60, 81/63.1; 192/43, 48.1, 48.92, 66.1, 69

(56) References Cited

U.S. PATENT DOCUMENTS 2,292,228 A * 8/1942 Krieger ..... 81/58.3
5,737,982 A * 4/1998 Lin ..... 81/58.3
5,782,146 A * 7/1998 Lin ..... 81/58.3
5,875,692 A * 3/1999 Lin ..... 81/58.3

* cited by examiner

*Primary Examiner*—Joseph J. Hail, III
*Assistant Examiner*—Joni B. Danganan

(74) *Attorney, Agent, or Firm*—A & J

(57) ABSTRACT

A reversible ratchet wrench includes a casing fastened to a tool handle to hold a tool bit holder shank and a tool bit at the shank, a forward control ratchet wheel and a backward control ratchet wheel concentrically mounted in the casing and supported on a respective spring means, a stop control ratchet wheel coupled to the tool bit holder shank for synchronous motion and forced by spring means into engagement with the forward control ratchet wheel and the backward control ratchet wheel, and a rotary control knob mounted on the casing and turned between a first position where the stop control ratchet wheel is maintained meshed with the forward control ratchet wheel and the backward control ratchet wheel, a second position where the forward control ratchet wheel is disengaged from the stop control ratchet wheel for enabling the tool bit holder shank to be rotated with the stop control ratchet wheel in one direction, and a third position where the backward control ratchet wheel is disengaged from the stop control ratchet wheel for enabling the tool bit holder shank to be rotated with the stop control ratchet wheel in the reversed direction.

2 Claims, 6 Drawing Sheets

REVERSIBLE RATCHET WRENCH

BACKGROUND OF THE INVENTION

The present invention relates to wrenches and, more particularly, to a reversible ratchet wrench, which has a simple structure, and is easy to operate.

Various reversible ratchet wrenches have been disclosed, and have appeared on the market. Conventional reversible ratchet wrenches are commonly complicated, and therefore their manufacturing cost is high. FIG. 8 shows a reversible ratchet wrench according to the prior art. This structure of reversible ratchet wrench comprises a casing, a ratchet wheel, two movable stop members, a spring, and a control wheel. The casing is a hollow cylindrical member, comprising a receiving chamber, which holds the ratchet wheel, enabling the ratchet wheel to be rotated with the tool bit holder shank attached thereto, and a side opening, which receives the stop members at two sides of the ratchet wheel. The spring forces the stop members into engagement with the ratchet wheel to stop the ratchet wheel from rotary motion relative to the casing. The control wheel is revolvably mounted on the casing, having a protruded block. By means of rotating the control wheel leftwards or rightwards, the protruded block is alternatively pressed on the stop members to control the direction of rotation of the ratchet wheel relative to the casing. Because this structure of reversible ratchet wheel is complicated, its manufacturing cost is high.

SUMMARY OF THE INVENTION

The present invention has been accomplished under the circumstances in view. It is the main object of the present invention to provide a simple structure of reversible ratchet wheel, which is inexpensive to manufacture. It is another object of the present invention to provide a simple structure ot reversible ratchet wheel, which is easy to operate. The reversible ratchet wheel of the present invention comprises a casing fastened to a tool handle to hold a tool bit holder shank and a tool bit at the shank, a forward control ratchet wheel and a backward control ratchet wheel concentrically mounted in the casing, first and second springs respectively mounted in the casing to support the forward control ratchet wheel and the backward control ratchet wheel respectively, a stop control ratchet wheel coupled to the tool bit holder shank tor synchronous motion, a third spring adapted to force the stop control ratchet wheel into engagement with the forward control ratchet wheel and the backward control ratchet wheel, and a rotary control knob mounted on the casing and turned between a first position where the stop control ratchet wheel is maintained meshed with the forward control ratchet wheel and the backward control ratchet wheel, a second position where the forward control ratchet wheel is disengaged from the stop control ratchet wheel tor enabling the tool bit holder shank to be rotated with the stop control ratchet wheel in one direction, and a third position where the backward control ratchet is disengaged from the stop control ratchet wheel for enabling the tool bit holder shank to be rotated with the stop control ratchet wheel in the reversed direction.

DETAILED DESCRIPTION OF THE PREFERRED EMBODIMENT

Figure 1:
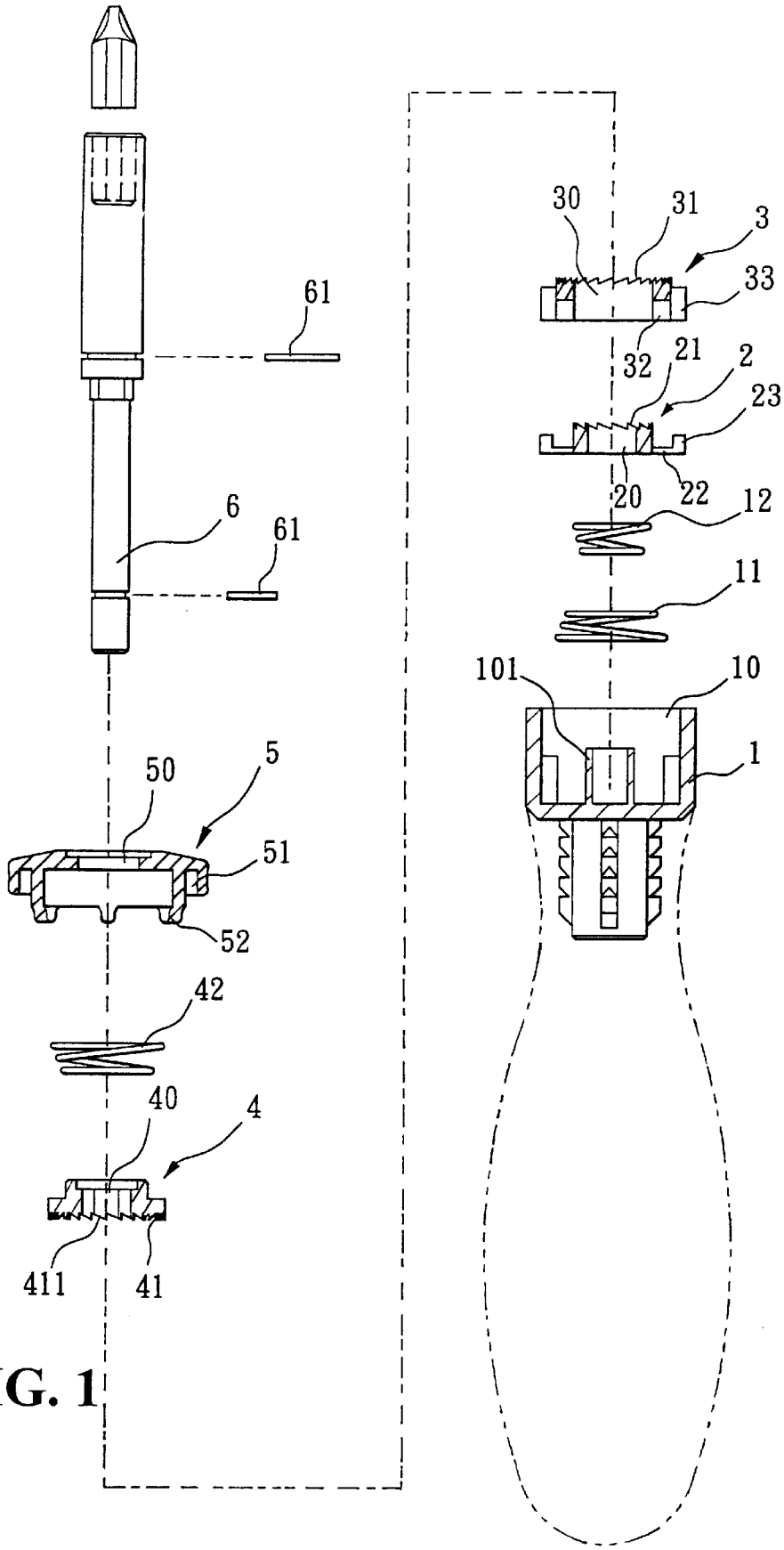
FIG. 1 is an exploded view of a reversible ratchet wrench according to the present invention.

Referring to FIG. 1, a reversible ratchet wrench in accordance with the present invention is generally comprised of a casing 1, a first spring member 11, a second spring member 12, a backward control ratchet wheel 2, a forward control ratchet wheel 3, a stop control ratchet wheel 4, a third spring member 42, and a rotary control knob 5. The casing 1 is adapted for coupling to a tool handle, comprising a receiving chamber 10, and an upright coupling tube 101 axially disposed in the receiving chamber 10. The first spring member 11 and the second spring member 12 are conical type compression springs. The outer diameter of the second spring member 12 is smaller than the inner diameter of the first spring member 11, so that the second spring member 12 can be received within the first spring member 11.

Figure 7B:
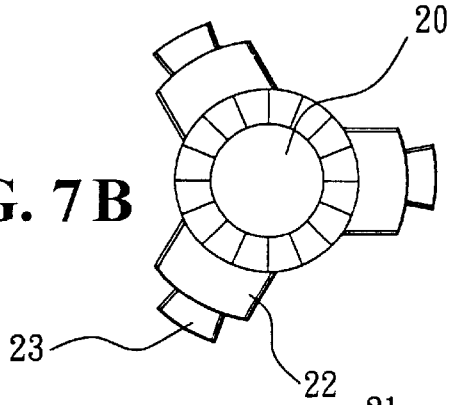
FIG. 7B is a sectional view of FIG. 7A.
Figure 7A:
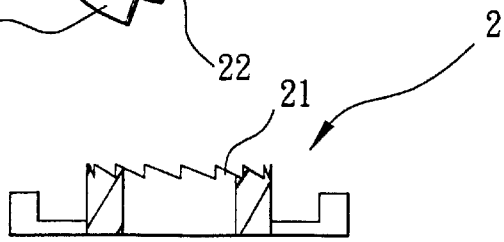
FIG. 7A is a top view of the backward control ratchet wheel according to the present invention.
Figure 8:
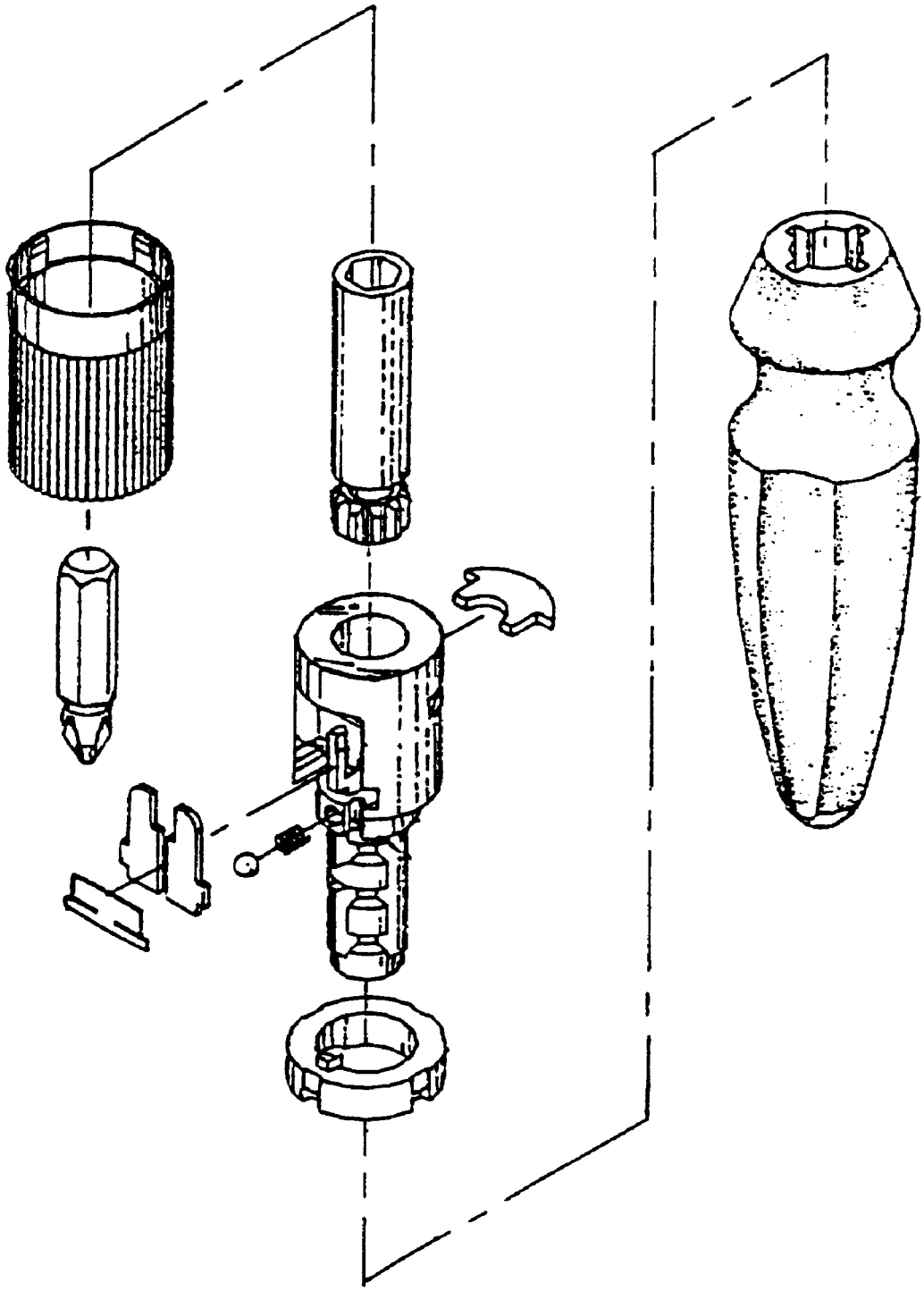
FIG. 8 PRIOR ART
FIG. 8 is an exploded view of a reversible ratchet wrench according to the prior art.

Referring to FIG. 7 and FIG. 1 again, the backward control ratchet wheel 2 is barrel-like disk comprising a center through hole 20, a series of teeth 21 sloping leftwards around the center through hole 20, a plurality of radial ribs 22 equiangularly spaced around the periphery, each radial rib 22 having an upwardly protruded block 23 of a predetermined height.

Figure 6B:
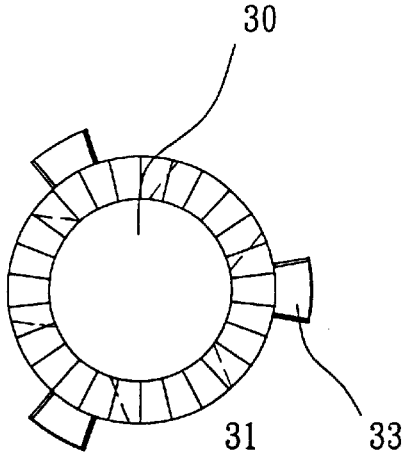
FIG. 6B is a sectional view of FIG. 6A.
Figure 6A:
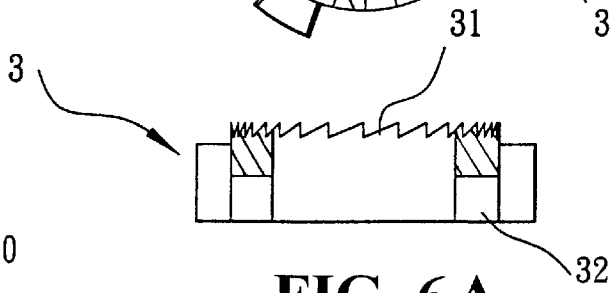
FIG. 6A is a top view of the forward control ratchet wheel according to the present invention.

Referring to FIG. 6 and FIG. 1 again, the forward control ratchet wheel 3 is a barrel-like disk comprising a center through hole 30, a series of teeth 31 sloping rightwards around the center through hole 30, a plurality of radial blocks 33 equiangularly spaced around the periphery, and a plurality of bottom grooves 32 disposed at the bottom side wall thereof corresponding to the radial ribs 22 of backward control ratchet wheel 2. The inner diameter of the center through hole 30 of the forward control ratchet wheel 3 is greater than the outer diameter of the backward control ratchet wheel 2. The backward control ratchet wheel 2 is put in the center through hole 30 of the forward control ratchet wheel 3 concentrically to force the radial ribs 22 into engagement with the bottom grooves 32 respectively, keeping the radial blocks 33 in alignment with the protruded blocks 23 respectively radially. After the backward control ratchet wheel 2 and the forward control ratchet wheel 3 have been assembled, they are put with the first spring member 11 and the second sprinig member 12 in the receiving chamber 10 of the casing 1 around the upright coupling tube 101, keeping the forward control ratchet wheel 3 and the backward control ratchet wheel 2 supported on the first spring member 11 and the second spring member 12 respectively.

Figure 5B:
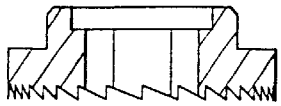
FIG. 5B is a sectional view of FIG. 5A.
Figure 5A:
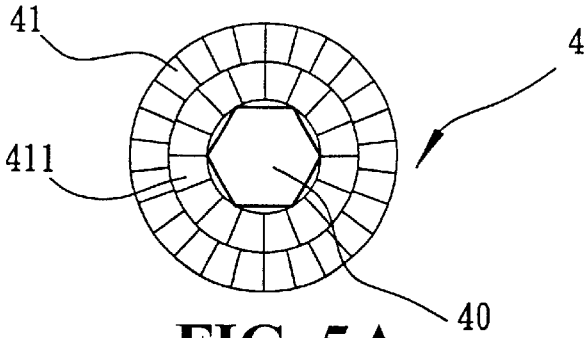
FIG. 5A is top view of the stop control ratchet wheel according to the present invention.

Referring to FIG. 5 and FIG. 1 again, the stop control ratchet wheel 4 comprises a center through hole 40, which has a cross section fitting the cross section of the tool bit holder shank 6, a series of first teeth 411 disposed at one side, namely, the bottom side thereof and sloping leftwards around the center through hole 40, and a series of second teeth 41 disposed at the bottom side and sloping rightwards around the series of first teeth 411. The tool bit holder shank 6 is inserted through the center through hole 40 of the stop control ratchet wheel 4 into the upright coupling tube 101 of the casing 1, and adapted to hold a tool bit. Further, retainer rings 61 are fastened to respectively outside annular grooves around the periphery of the tool bit holder shank 6 to secure the tool bit holder shank 6 to the casing 1, enabling the tool bit holder shank 6 to be rotated in the upright coupling tube 101. The stop control ratchet wheel 4 is inserted into the receiving chamber 10 of the casing 1, keeping the series of first teeth 411 and the series of second teeth 41 respectively meshed with the series of teeth 21 of the backward control ratchet wheel 2 and the series of teeth 31 of the forward control ratchet wheel 3. The third spring member 42 is mounted on the top of the stop control ratchet wheel 4. The rotary control knob 5 is covered on the receiving chamber 10 of the casing 1, comprising an annular coupling groove 51 disposed at the bottom side thereof and coupled to the peripheral wall of the casing 1, a center through hole 50 for the passing of the tool bit holder shank 6, and a plurality of downwardly extended protruded blocks 52.

Figure 2:
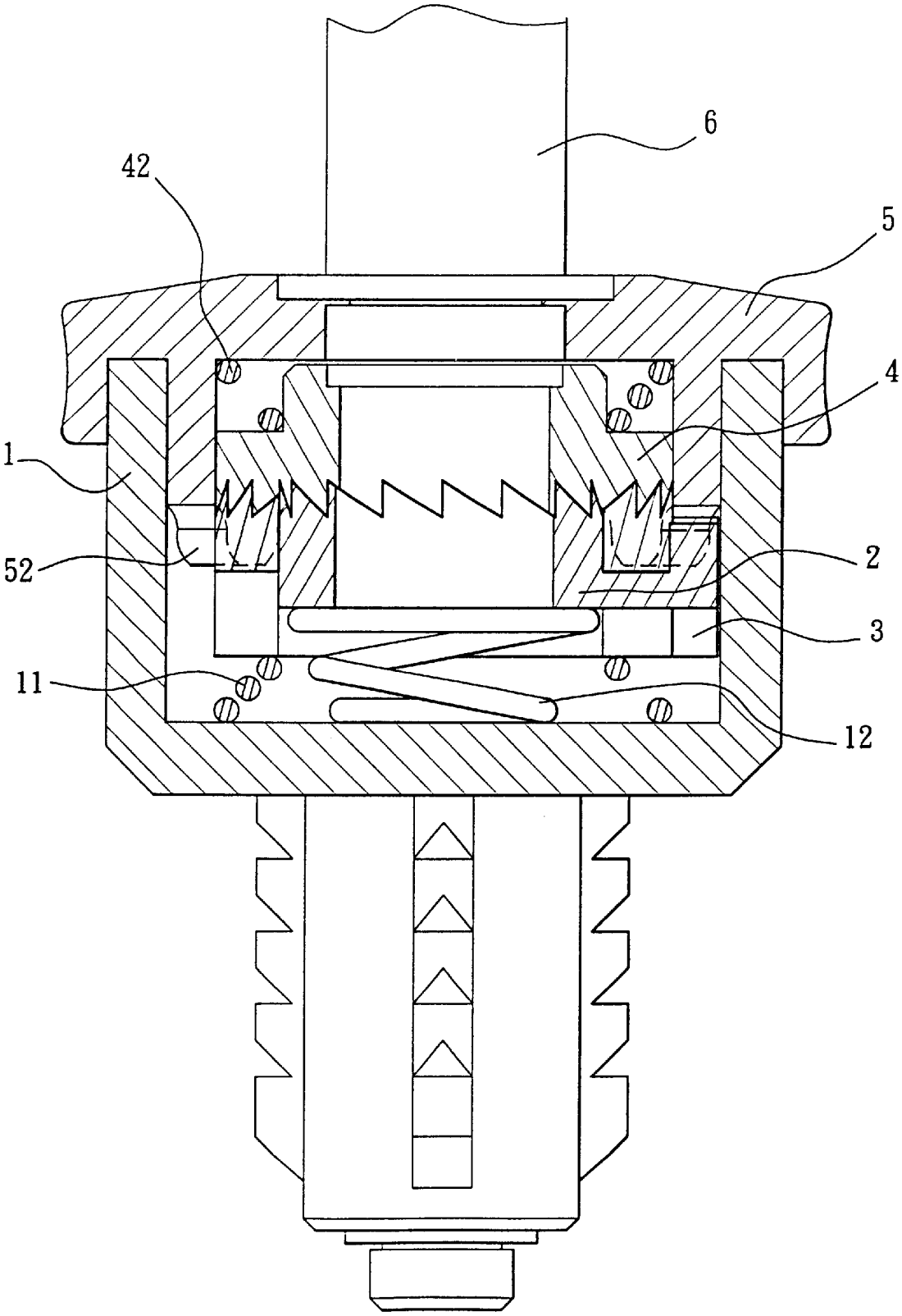
FIG. 2 is a sectional assembly view of the present invention, showing the stop control ratchet wheel meshed with the forward control ratchet wheel and the backward control ratchet wheel.
Figure 3:
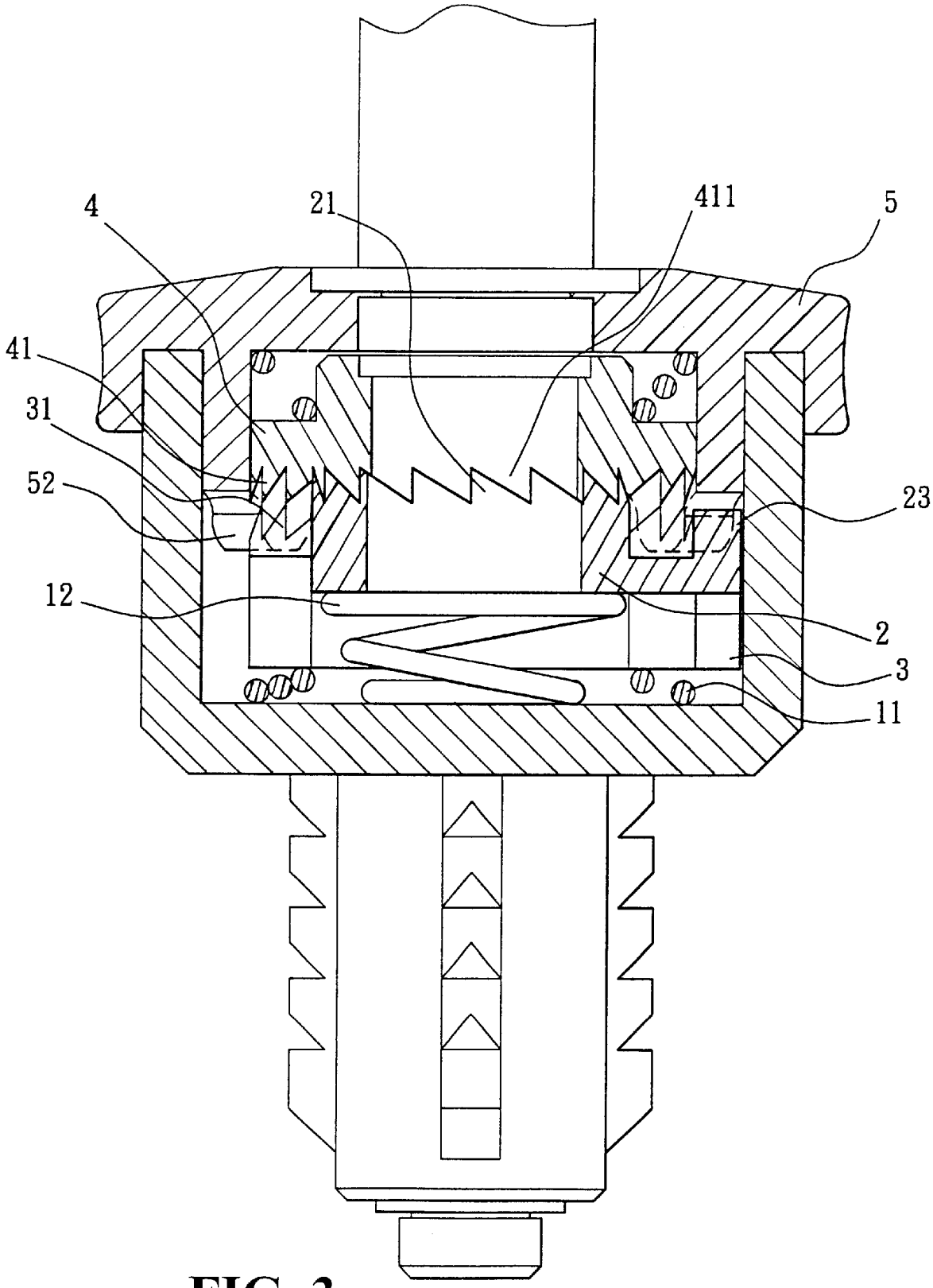
FIG. 3 is similar to FIG. 2 but showing the forward control ratchet wheel disengaged from the stop control ratchet wheel, the backward control ratchet wheel meshed with the stop control ratchet wheel.
Figure 4:
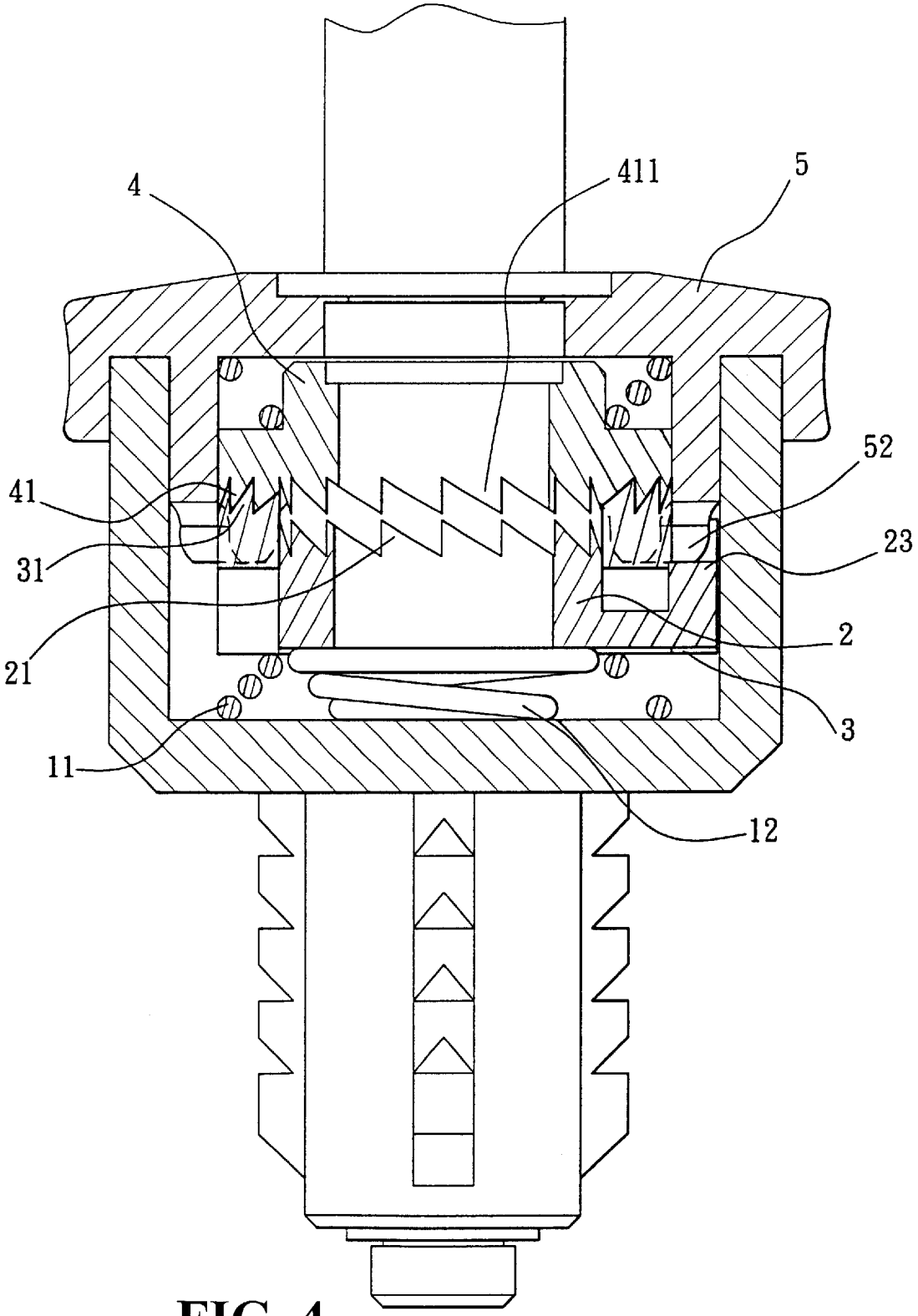
FIG. 4 is similar to FIG. 2 but showing the backward control ratchet wheel disengaged from the stop control ratchet wheel, the forward control ratchet wheel meshed with the stop control ratchet wheel.

When assembled, as shown in FIG. 2, the rotary control knob 5 can be rotated to control the working direction of the tool bit holder shank 6. FIG. 2 shows the downwardly extended protruded blocks 52 of the rotary control knob 5 do no action to the radial blocks 33 of the forward control ratchet wheel 3 and the protruded blocks 23 of the backward control ratchet wheel 2, the forward control ratchet wheel 3 and the backward control ratchet wheel 2 are respectively pushed outwards by the spring members 12 and 13 to force the respective series of teeth 31 and 21 into engagement with the first and second series of teeth 41 and 411 of the stop control ratchet wheel 4, and therefore the tool bit holder shank 6 is stopped from rotary motion relative to the casing 1. Referring to FIG. 3, when rotating the rotary control knob 5 in one direction, the downwardly extended protruded blocks 52 of the rotary control knob 5 force the radial blocks 33 of the forward control ratchet wheel 3 downwards to disengage the forward control ratchet wheel 3 from the stop control ratchet wheel 4. At this time, the backward control ratchet wheel 2 is still maintained meshed with the stop control ratchet wheel 4, and therefore the tool bit holder shank 6 can be rotated in one direction relative to the casing 1. Referring to FIG. 4 when rotating the rotary control knob 5 in the reversed direction, the downwardly extended protruded blocks 52 of the rotary control knob 5 force the protruded blocks 23 of the backward control ratchet wheel 2 downwards to disengage the backward control ratchet wheel 2 from the stop control ratchet wheel 4. At this time, the forward control ratchet wheel 3 is still maintained meshed with the stop control ratchet wheel 4, and therefore the tool bit holder shank 6 can be rotated in the reversed direction relative to the casing 1.

While only one embodiment of the present invention has been shown and described, it will be understood that various modifications and changes could be made thereunto without departing from the spirit and scope of the invention disclosed.

What the invention claimed is:

1. A reversible ratchet wrench fastened to a tool handle to hold a tool bit holder shank and set between a first position where said tool bit holder shank is stopped from rotary motion relative to the reversible ratchet wrench, a second position where said tool bit holder shank is allowed to be rotated in one direction relative to the reversible ratchet wrench, and a third position where said tool bit holder shank is allowed to be rotated in the reversed direction relative to the reversible ratchet wrench, the reversible ratchet wrench comprising:

a casing fastened to the tool handle and holding a tool bit holder shank for holding a tool bit;

first spring means mounted in said casing;

a backward control ratchet wheel supported on said first spring means inside said casing, said backward control ratchet wheel comprising a center through hole for the passing of the tool bit holder shank, a series of teeth disposed at a top side thereof and sloping leftwards around the center through hole of said backward control ratchet wheel, a plurality of radial ribs equiangularly spaced around the periphery thereof, said radial ribs each having an upwardly protruded block;

second spring means mounted in said casing;

forward control ratchet wheel concentrically mounted with said backward control ratchet wheel and supported on said second spring means inside said casing, said forward control ratchet wheel comprising a center through hole for the passing of the tool bit holder shank, a series of teeth disposed at a top side thereof and sloping rightwards around the center through hole of said forward control ratchet wheel, and a plurality of radial blocks equiangularly spaced around the periphery thereof;

a stop control ratchet wheel mounted in said casing, said stop control ratchet wheel comprising a center through hole, which receives the tool bit holder shank to stop the tool bit holder shank from rotary motion relative to said stop control ratchet wheel, a series of first teeth and a series of second teeth concentrically disposed at a bottom side thereof and sloping in reversed directions and adapted for engaging the series of teeth of said backward control ratchet wheel and the series of teeth of said forward control ratchet wheel;

third spring member mounted in said casing and adapted to force said stop control ratchet wheel into engagement with said forward control ratchet wheel and said backward control ratchet wheel; and a rotary control knob covered on said casing and rotated between said first position, said second position and said third position, said rotary control knob comprising a center through hole for the passing of the tool bit holder shank, and a plurality of downwardly extended protruded blocks;

wherein the downwardly extended protruded blocks of said rotary control knob are disconnected from the radial blocks of said forward control ratchet wheel and the protruded blocks of said backward control ratchet wheel for enabling said stop control ratchet wheel to be forced by said third spring means into engagement with said forward control ratchet wheel and said backward control ratchet wheel to stop the tool bit holder shank from rotary motion relative to said casing when said rotary control knob is turned to said first position; the downwardly extended protruded blocks of said rotary control knob are pressed on the radial blocks of said forward control ratchet wheel to disengage said forward control ratchet wheel for enabling said tool bit holder shank to be rotated with said stop control ratchet wheel in one direction when said rotary control knob is turned to said second position; the downwardly extended protruded blocks of said rotary control knob are pressed on the protruded blocks of said backward control ratchet wheel to disengage said backward control ratchet wheel from said stop control ratchet wheel for enabling said tool bit holder shank to be rotated with said stop control ratchet wheel in the reversed direction when said rotary control knob is turned to said third position.

2. The reversible ratchet wrench of claim 1, wherein said first spring means is a conical compression spring, and said second spring means is a conical compression spring of relatively smaller diameter than said first spring means disposed within said first spring means.

* * * * *